US010474075B1

(12) United States Patent
Kawashima

(10) Patent No.: US 10,474,075 B1
(45) Date of Patent: Nov. 12, 2019

(54) FIXING DEVICE AND IMAGE FORMING APPARATUS

(71) Applicant: TOSHIBA TEC KABUSHIKI KAISHA, Shinagawa-ku, Tokyo (JP)

(72) Inventor: Yuki Kawashima, Kannami Tagata Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/043,416

(22) Filed: Jul. 24, 2018

(51) Int. Cl.
*G03G 15/20* (2006.01)
*G03G 15/08* (2006.01)

(52) U.S. Cl.
CPC ..... *G03G 15/2064* (2013.01); *G03G 15/0806* (2013.01); *G03G 15/0865* (2013.01); *G03G 15/2028* (2013.01); *G03G 15/2039* (2013.01)

(58) Field of Classification Search
None
See application file for complete search history.

(56) References Cited

U.S. PATENT DOCUMENTS 9,335,685 B2 5/2016 Takeuchi
2014/0016971 A1* 1/2014 Arai ..... G03G 15/2053 399/329
2017/0261899 A1* 9/2017 Gotoh ..... G03G 15/2053

* cited by examiner

*Primary Examiner* — Victor Verbitsky
(74) *Attorney, Agent, or Firm* — Foley & Lardner LLP

(57) ABSTRACT

According to one embodiment, a fixing device includes a circulating member for fixing, a pressure member, a heater, a reflector, a heat storage section, and a driving device. The circulating member for fixing includes an annular peripheral wall circularly movable. The pressure member is arranged to face an outer peripheral surface of the circulating member for fixing and forms a nip with the circulating member for fixing. The heater is arranged inside the circulating member for fixing and heats the circulating member for fixing. The reflector is arranged inside the circulating member for fixing and reflects radiant heat of the heater to the circulating member for fixing. The heat storage section is provided integrally with the reflector or connected to the reflector. The driving device causes the heat storage section to abut on or separate from an inner peripheral surface of the circulating member for fixing.

17 Claims, 6 Drawing Sheets

FIXING DEVICE AND IMAGE FORMING APPARATUS

FIELD

Embodiments described herein relate generally to a fixing device and an image forming apparatus.

BACKGROUND

An image forming apparatus such as a multi function peripheral (MFP), a copy machine, and a printer includes a fixing device for fixing a toner image transferred to a recording medium such as a recording sheet.

A fixing device includes a fixing belt (circulating member for fixing) of which an annular peripheral wall circularly moves and a pressure roller (pressure member) that is pressed against the outer surface of the fixing belt. The pressure roller is driven to rotate by a driving device such as a motor. A nip for fixing is formed between the pressure roller and the fixing belt. A recording medium, such as a recording sheet, which is a fixing target, passes through the nip for fixing.

A pad material which presses the fixing belt from the inside thereof, a heater for heating the fixing belt, and a holding member which holds the pad material are arranged inside the fixing belt. The pressed surface of the pad material receives a pressure from the pressure roller via the fixing belt.

As a fixing device in the related art, there is devised a fixing device including a reflector for reflecting radiant heat of a heater toward a fixing belt. In this fixing device, radiant heat of the heater proceeding in a direction of a member other than the fixing belt, such as a holding member, is blocked by the reflector and the radiant heat is reflected in a direction of the fixing member. As a result, the heating efficiency of the fixing belt by the heater is increased.

However, in the fixing device, some of the radiant heat emitted from the heater to the reflector heats the reflector. Then, the heat of the heated reflector is not used for heating the fixing belt and escapes to a member other than the fixing belt, such as a holding member. Therefore, it is desirable to have a fixing device capable of more efficiently heating a fixing belt by using heat of a reflector heated by a heater.

DETAILED DESCRIPTION

In general, according to one embodiment, a fixing device includes a circulating member for fixing, a pressure member, a heater, a reflector, a heat storage section, and a driving device. The circulating member for fixing is configured to include an annular peripheral wall which is circularly movable. The pressure member is arranged to face an outer peripheral surface of the circulating member for fixing and forms a nip with the circulating member for fixing. The heater is arranged inside the circulating member for fixing and heats the circulating member for fixing. The reflector is arranged inside the circulating member for fixing and reflects radiant heat of the heater to the circulating member for fixing. The heat storage section is provided integrally with the reflector or is connected to the reflector. The driving device causes the heat storage section to abut on or separate from an inner peripheral surface of the circulating member for fixing.

Hereinafter, an image forming apparatus according to an embodiment will be described with reference to drawings. In each drawing, the same components are assigned with the same reference marks.

Figure 1:
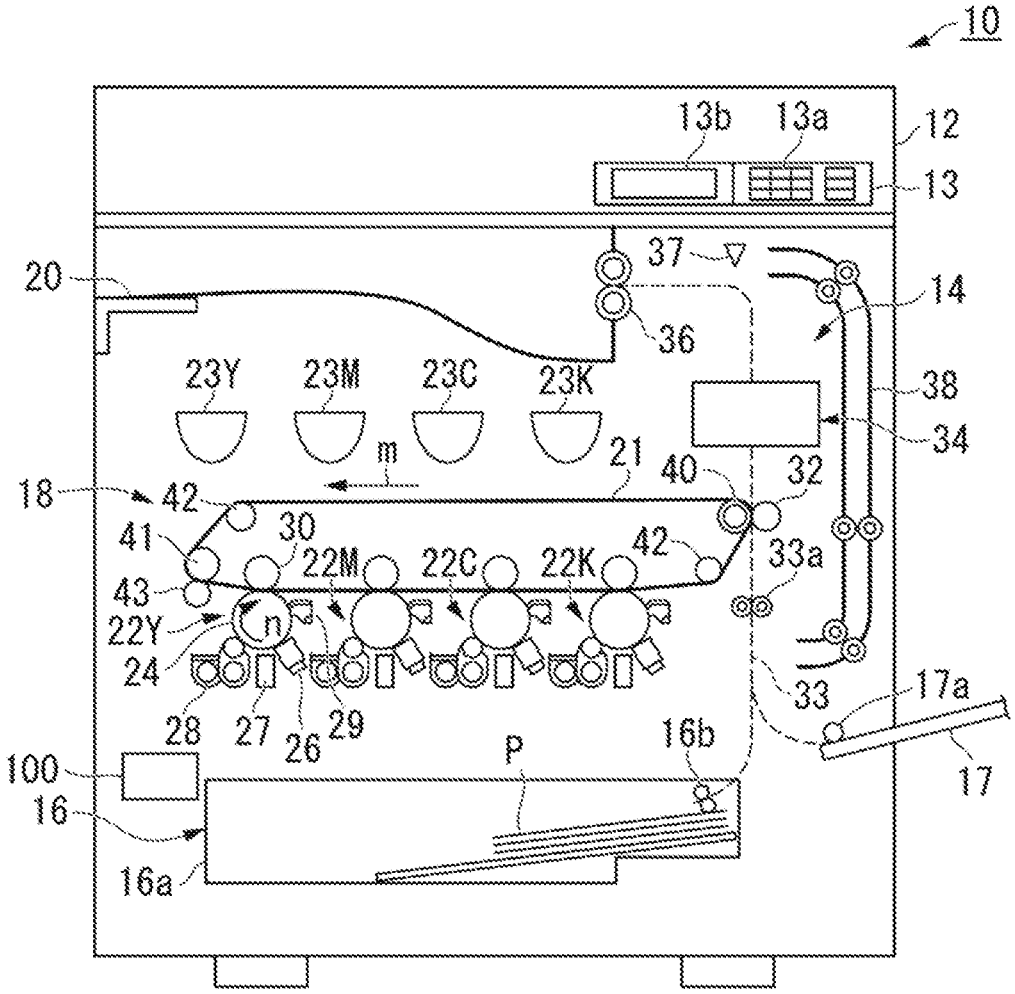
FIG. 1 is a side view of an image forming apparatus including a fixing device according to an embodiment.

FIG. 1 is a side view of an overall configuration of an image forming apparatus 10 according to an embodiment. For example, the image forming apparatus 10 is a multi function peripheral. However, the image forming apparatus 10 is not limited to the above example and may be a copy machine, a printer, or the like.

The image forming apparatus 10 includes a scanner 12, a control panel 13, a main body section 14, and a control device 100. The main body section 14 includes a sheet feeding cassette section 16, a printer section 18, a fixing device 34, and the like. The control device 100 controls the entire image forming apparatus 10. For example, the control device 100 controls operations of the scanner 12, the control panel 13, the sheet feeding cassette section 16, the printer section 18, the fixing device 34, and the like.

The scanner 12 reads an image of an original. The control panel 13 includes input keys 13*a* and a display section 13*b*. For example, the input keys 13*a* receive an input of a user. For example, the display section 13*b* is a touch panel type. The display section 13*b* receives the input by the user to display the input to the user.

The sheet feeding cassette section 16 includes a cassette main body 16*a* and pickup rollers 16*b*. The cassette main body 16*a* houses a sheet P serving as an image medium. The pickup rollers 16*b* take out the sheet P from the cassette main body 16*a*. The sheet P taken out from the cassette main body 16*a* is fed to a conveyance path 33.

The printer section 18 forms an image on the sheet P. For example, the printer section 18 forms an image read from an image of an original by the scanner 12. The printer section 18 includes an intermediate transfer belt 21. The printer section 18 supports the intermediate transfer belt 21 with a backup roller 40, a driven roller 41, and tension rollers 42. The backup roller 40 is equipped with a driving section (not illustrated). The printer section 18 rotates the intermediate transfer belt 21 in an arrow m direction.

The printer section 18 includes four groups of image forming stations including the image forming stations 22Y, 22M, 22C and 22K. The image forming stations 22Y, 22M, 22C and 22K are respectively used to form a Y (yellow) image, an M (magenta) image, a C (cyan) image and a K (black) image. The image forming stations 22Y, 22M, 22C and 22K, which are located at the lower side of the intermediate transfer belt 21, are arranged in parallel along the rotation direction of the intermediate transfer belt 21.

The printer section 18 includes cartridges 23Y, 23M, 23C and 23K above the image forming stations 22Y, 22M, 22C and 22K correspondingly. The cartridges 23Y, 23M, 23C and 23K are used to house a Y (yellow) toner, an M (magenta) toner, a C (cyan) toner and a K (black) toner for replenishment.

Hereinafter, among the image forming stations 22Y, 22M, 22C and 22K, the image forming station 22Y of Y (yellow) is described as an example. Further, since the image forming stations 22M, 22C and 22K have the same configuration as the image forming station 22Y, the detailed description thereof is omitted.

The image forming station 22Y includes a charging charger 26, an exposure scanning head 27, a developing device 28, and a photoconductor cleaner 29. The charging charger 26, the exposure scanning head 27, the developing device 28, and the photoconductor cleaner 29 are arranged around a photoconductive drum 24 which rotates in the arrow n direction.

The image forming station 22Y includes a primary transfer roller 30. The primary transfer roller 30 faces the photoconductive drum 24 across the intermediate transfer belt 21.

After charging the photoconductive drum 24 with the charging charger 26, the image forming station 22Y exposes the photoconductive drum 24 with the exposure scanning head 27. The image forming station 22Y forms an electrostatic latent image on the photoconductive drum 24. The developing device 28 develops the electrostatic latent image on the photoconductive drum 24 with a two-component developing agent formed by a toner and a carrier.

The primary transfer roller 30 primarily transfers a toner image formed on the photoconductive drum 24 onto the intermediate transfer belt 21. The image forming stations 22Y, 22M, 22C and 22K form a color toner image on the intermediate transfer belt 21 with the primary transfer roller 30. The color toner image is formed by overlapping the Y (yellow) toner image, the M (magenta) toner image, the C (cyan) toner image and the K (black) toner image in order. The photoconductor cleaner 29 removes the toner left on the photoconductive drum 24 after the primary transfer.

The printer section 18 includes a secondary transfer roller 32. The secondary transfer roller 32 faces the backup roller 40 across the intermediate transfer belt 21. The secondary transfer roller 32 secondarily transfers the color toner image on the intermediate transfer belt 21 collectively onto a sheet P. The sheet P is fed from the sheet feeding cassette section 16 or a manual sheet feed tray 17 along a conveyance path 33.

The printer section 18 includes a belt cleaner 43 facing the driven roller 41 across the intermediate transfer belt 21, The belt cleaner 43 is used to remove the toner left on the intermediate transfer belt 21 after the secondary transfer.

The conveyance path 33 includes resist rollers 33*a*, the fixing device 34, and sheet discharging rollers 36. The printer section 18 includes a branching section 37 and a reverse conveyance section 38 at the downstream side of the fixing device 34 of the conveyance path 33. The branching section 37 sends the sheet P after a fixing processing to a discharging section 20 or the reverse conveyance section 38. In a case of duplex printing, a reverse conveyance section 38 reverses the sheet P sent from the branching section 37 to the direction of the resist rollers 33*a* to convey the sheet P. The image forming apparatus 10 forms a fixed toner image on the sheet P with the printer section 18 to discharge the sheet P to the discharging section 20.

The image forming apparatus 10 is not limited to a tandem developing method, and the number of the developing devices 28 is also not limited. Further, the image forming apparatus 10 may directly transfer the toner image from the photoconductive drum 24 onto the sheet P.

Hereinafter, the fixing device 34 is described in detail.

Figure 2:
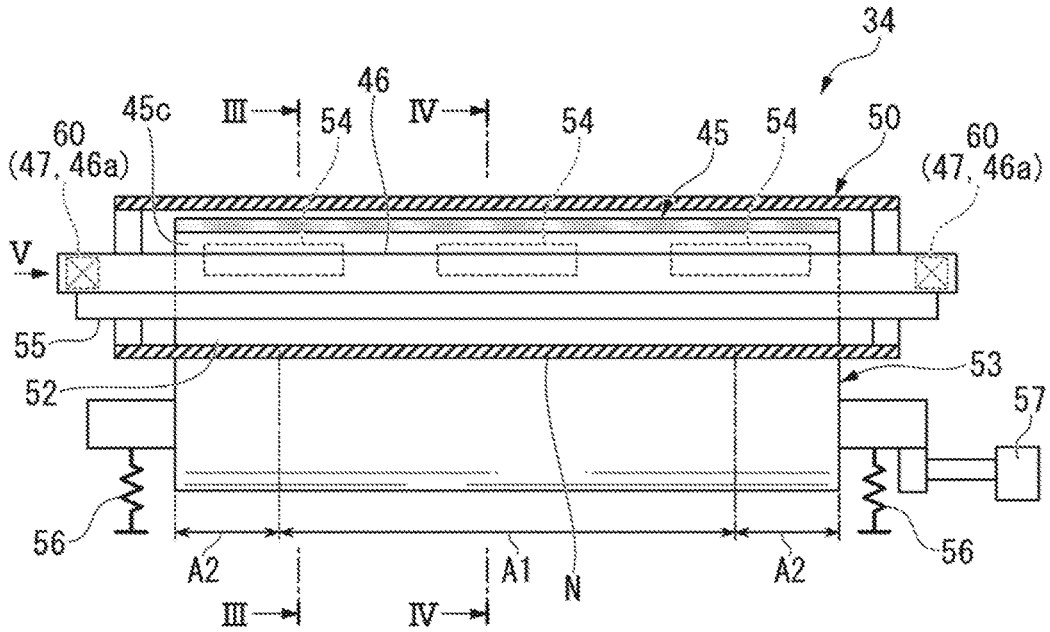
FIG. 2 is a top view of a cross section of a part of the fixing device.
Figure 3:
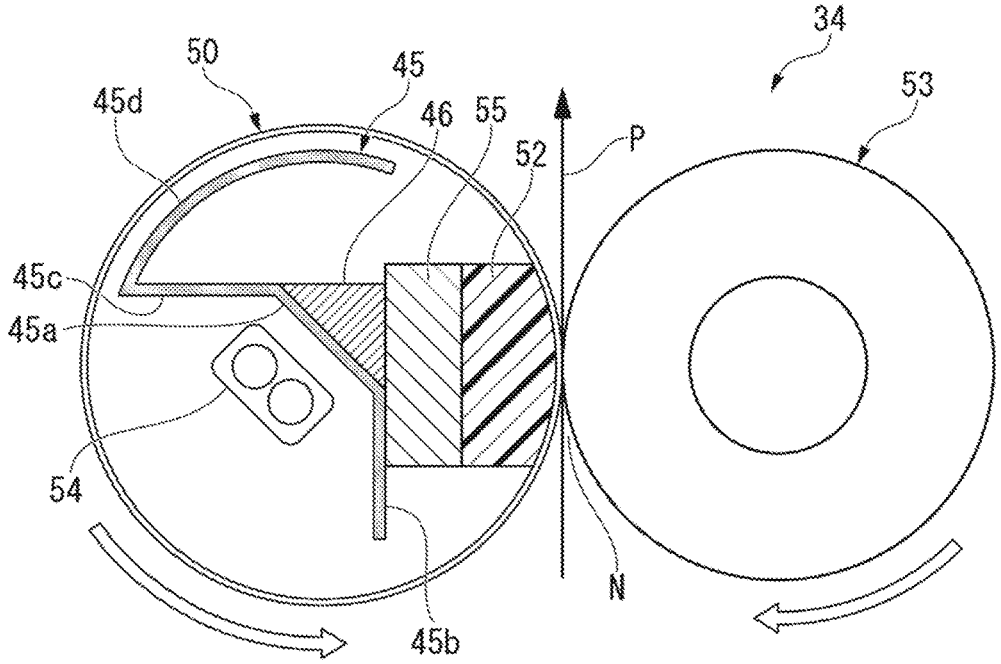
FIG. 3 is a cross-sectional view of the fixing device taken along line in FIG. 2.
Figure 4:
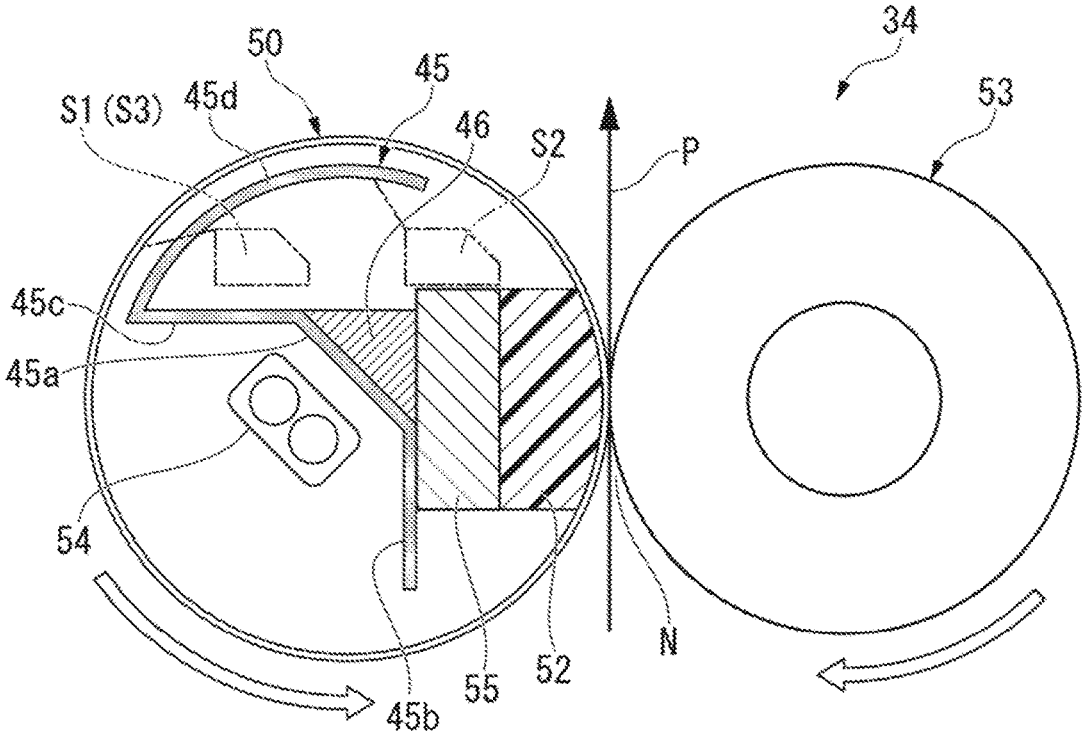
FIG. 4 is a cross-sectional view of the fixing device taken along line IV-IV in FIG. 2.
Figure 5:
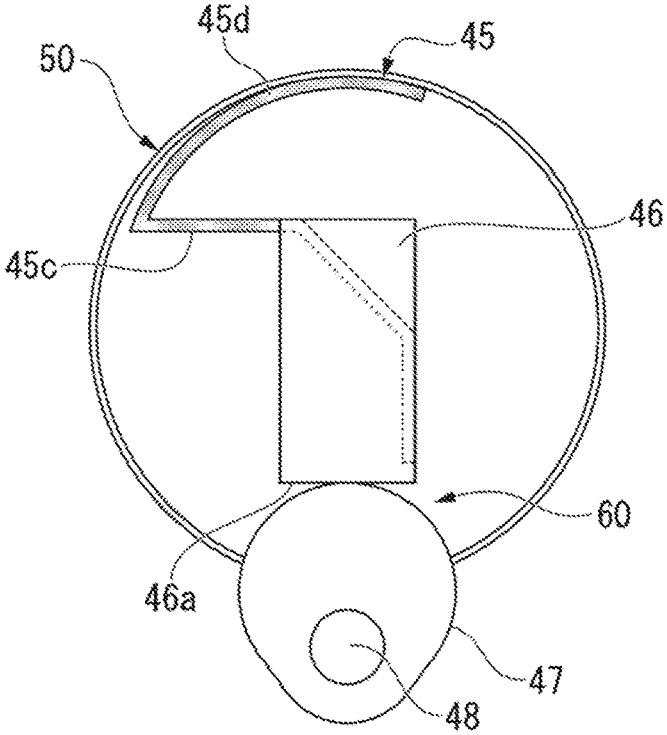
FIG. 5 is a side view of the fixing device corresponding to an arrow V in FIG. 2.

FIG. 2 is a top view of a cross section of a part of the fixing device 34. FIG. 3 is a cross-sectional view of the fixing device 34 taken along line III-III in FIG. 2. FIG. 4 is a cross-sectional view of the fixing device 34 taken along line IV-IV in FIG. 2. FIG. 5 is a side view of the fixing device 34 corresponding to an arrow V in FIG. 2.

The fixing device 34 includes an endless fixing belt 50 of which an annular peripheral wall circularly moves and a pressure roller 53 which is arranged to face an outer peripheral surface of the fixing belt 50 and forms a nip N for fixing between the pressure roller and the fixing belt 50. The fixing belt 50 is an embodiment of the circulating member for fixing and the pressure roller 53 is an embodiment of the pressure member. In the case of the embodiment, the fixing belt 50 is formed in a substantially cylindrical shape. However, the fixing belt does not necessarily have a cylindrical shape and may have an elliptic shape or other annular cross-sectional shapes.

The fixing belt 50 has a multilayer structure. The fixing belt 50 includes a base layer of nickel, polyimide, or the like, an elastic layer of Si rubber or the like arranged outside the base layer, and a release layer arranged outside the elastic layer. Since the release layer is a layer which comes into direct contact with a toner on the sheet P (recording medium), the release layer is preferably formed of a fluorine-based resin having good releasability such as PFA. It is preferable that the inner surface of the fixing belt 50 is coated with a black fluorine-based resin to increase slidability and easily absorb radiant heat of a heater 54 which will described later.

The fixing belt 50 is driven to rotate by receiving the driving force of the pressure roller 53. The fixing belt 50 may be driven by a driving unit such as a motor separately from the pressure roller 53.

Inside the fixing belt 50, a pad material 52 for fixing which presses the fixing belt 50 in a direction of the pressure roller 53, a radiation type heater 54 which heats the fixing belt 50 at the time of fixing operation, a reflector 45 which reflects radiant heat of the heater 54 in a predetermined range inside the fixing belt 50, and a metal holding member 55 which holds the pad material 52 and the reflector 45 are arranged. The holding member 55 extends to the outside from the fixing belt 50 in a longitudinal direction and end portions of both sides in the longitudinal direction are supported by a support frame (not illustrated).

The pad material 52 is arranged at a location facing the pressure roller 53 while interposing the fixing belt 50 therebetween. The pad material 52 supports the inner peripheral surface of the fixing belt 50. The pressure roller 53 pressurizes the fixing belt 50 supported by the pad material 52 and forms a nip N for fixing between the fixing belt 50 and the pressure roller 53. The pad material 52 is formed of for example, heat resistant polyphenylene sulfide resin (PPS) or the like. A1 in FIG. 2 is a sheet passing area (an area where a sheet P having a normal width passes through) of the fixing belt 50 in the longitudinal direction, and A2 in FIG. 2 is a sheet non-passing area (an area where a sheet P having a normal width does not pass through) of the fixing belt 50 in the longitudinal direction.

For the heater 54, for example, a halogen heater or the like can be used. The heater 54 is arranged in plural places of the fixing belt 50 separated from each other in the longitudinal direction. The heater 54 is supported by the reflector 45.

The reflector 45 is formed by deposition of aluminum, silver, or the like on the surface of a base formed of aluminum or the like. The reflectance of radiant heat at the reflector 45 is about 90%. About 10% of the left radiant heat not reflected by the reflector 45 is absorbed by the reflector 45. As a result, the reflector 45 is heated.

The reflector 45 is formed to have an almost uniform cross section in the longitudinal direction. As illustrated in FIGS. 3 to 5, the reflector 45 includes a flat base wall 45*a* facing a rear surface of the heater 54, a flat inclined wall 45*b* inclined to form an obtuse angle with a front surface of the base wall 45*a* (a surface facing the heater 54) while extending from one end of the base wall 45*a*, a flat inclined wall 45*c* inclined to form an obtuse angle with the front surface of the base wall 45*a* while extending from the other end of the base wall 45*a*, and a heat storage wall 45*d* having a substantially circular arc shape and provided continuously to the end portion of the inclined wall 45*c*. The rear surface of the heater 54 means a surface opposite to the surface of the heater 54 directly facing the inner surface of the fixing belt 50.

The base wall 45*a* and the inclined walls 45*b* and 45*c* on both sides thereof constitute the main body section of the reflector 45. The main body section of the reflector 45 reflects the radiant heat emitted from the heater 54 to the rear surface in the direction of the inner surface of the fixing belt 50. The heat storage wall 45*d* has a cross sectional shape formed substantially along the inner peripheral surface of the fixing belt 50. In the case of the embodiments, the heat storage wall 45*d* constitutes the heat storage section provided integrally with the reflector 45.

The heat storage section may be constituted by a member separately from the reflector 45 to be connected to the reflector 45 by an appropriate unit. In this case, the heat storage section can also be formed of a material having heat storage properties higher than heat storage properties of the reflector 45.

The reflector 45 is held by a connecting rod 46 having a triangular prism shape in a state in which the base wall 45*a* is inclined at about 45° in a vertical direction. The connecting rod 46 causes the inside of the fixing belt 50 to extend in the longitudinal direction and both end portions thereof protrude from the fixing belt 50 in the longitudinal direction. In the both end portions of the connecting rod 46 extending to the outside from the fixing belt 50, as illustrated in FIG. 5, cam bearings 46*a* each protruding toward the lower side in the vertical direction are provided. The surface of the connecting rod. 46 facing the holding member 55 is a guide surface guided by the holding member 55. The guide surface is formed to be flat along the vertical direction. The vertical operation of the connecting rod 46 is guided by the holding member 55.

On the lower side of the cam bearing 46*a*, an operation cam 47 which is operated to be driven by a motor (not illustrated) is arranged. An outer peripheral surface of the operation cam 47 abuts on a lower surface of the cam bearing 46*a* of the connecting rod 46. In the embodiment, the cam bearing 46*a* always abuts on outer peripheral surface of the operation cam 47 due to its weight of the connecting rod 46 or the reflector 45. The outer peripheral surface of the operation cam 47 has a cam profile set such that a distance from the center of the driving shaft 48 continuously changes. Therefore, the driving shaft 48 is operated to appropriately rotate by a motor (not illustrated), thereby changing the height of the upper surface of the operation cam 47. Accordingly, when the operation cam 47 is operated to rotate by the motor, the elevating or lowering height of the connecting rod 46 and the reflector 45 is adjusted. When the elevating or lowering height of the reflector 45 is adjusted, the curved heat storage wall 45*d* of the reflector 45 approaches or separates from the inner peripheral surface of the fixing belt 50. In the embodiments, the motor which drives the driving shaft 48 to rotate, the operation cam 47, and the cam bearing 46*a* of the connecting rod 46 constitute a driving device 60 having a configuration in which the heat storage wall 45*d* of the reflector 45 approaches or separates from the inner peripheral surface of the fixing belt 50.

Figure 6:
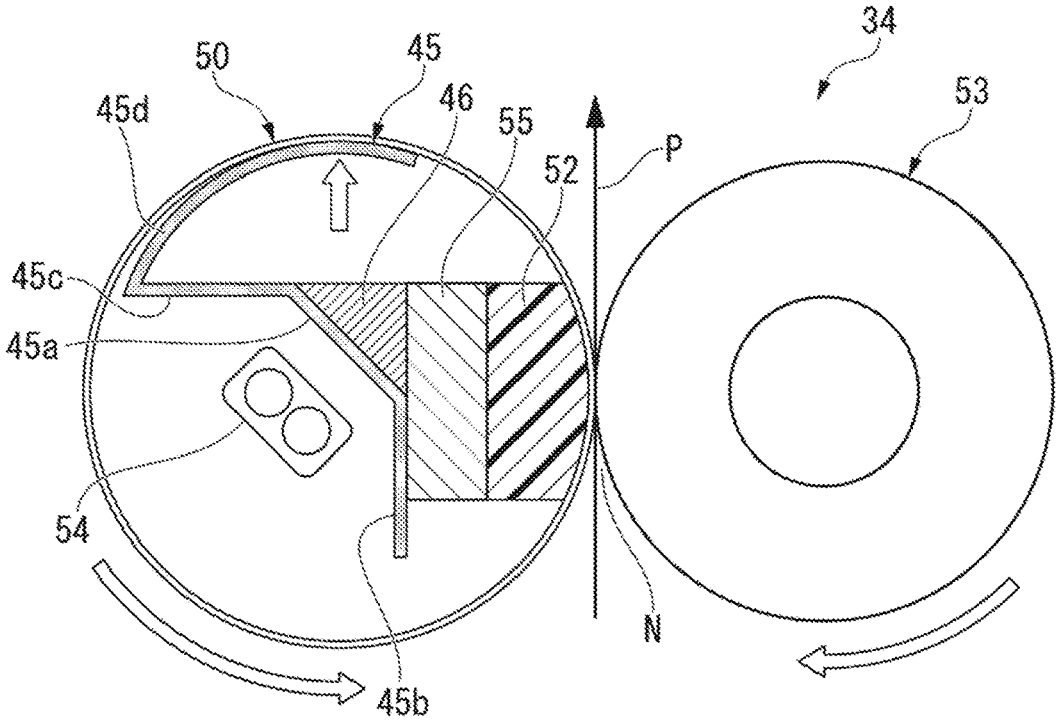
FIG. 6 is a cross-sectional view similar to FIG. 4 and illustrating an operation state of the fixing device.

FIG. 6 is a cross-sectional view similar to FIG. 4 and illustrating a state when the heat storage wall 45*d* abuts on the inner peripheral surface of the fixing belt 50 by rotational operation by the operation cam 47.

Heat is transferred between the reflector 45 and the fixing belt 50 when the heat storage wall 45*d* abuts on the inner peripheral surface of the fixing belt 50 by rotational operation by the operation cam 47. Specifically, in a case where the heat storage wall 45*d* abuts on the inner peripheral surface of the fixing belt 50 when the temperature of the reflector 45 (heat storage wall 45*d*) is higher than the temperature of the fixing belt 50, the heat of the reflector 45 is transferred to the fixing belt 50. In contrast, in a case where the heat storage wall 45*d* abuts on the inner peripheral surface of the fixing belt 50 when the temperature of the fixing belt 50 is higher than the temperature of the reflector 45 (heat storage wall 45*d*), the heat of the fixing belt 50 is transferred (escapes) to the reflector 45.

In the case of the embodiments, a combined heat capacity of the heat storage wall 45*d* and the main body section of the reflector 45 is set to be three times or more the heat capacity of the fixing belt 50.

Figure 7:
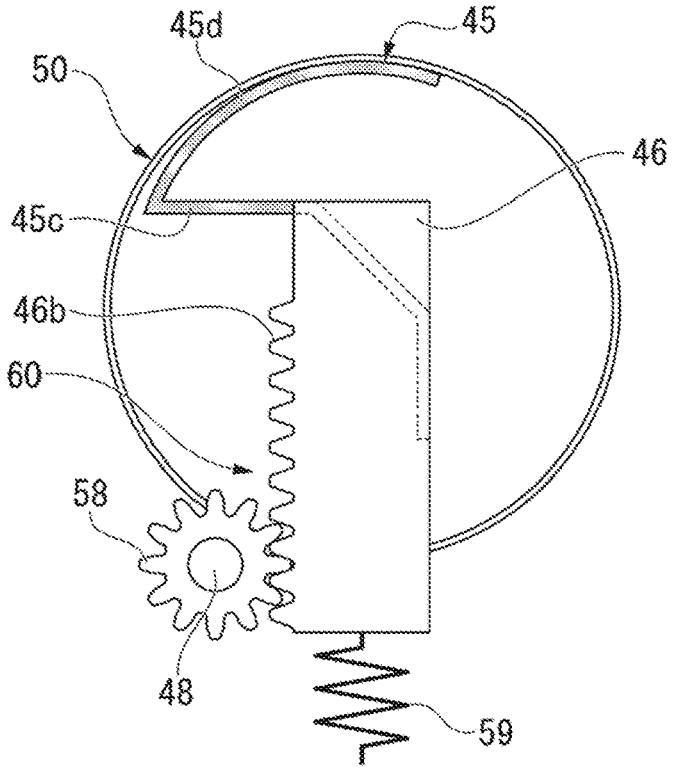
FIG. 7 is a side view similar to FIG. 5 and illustrating a modification example of the fixing device.

FIG. 7 is a side view similar to FIG. 5 and illustrating a modification example of the embodiment.

In the modification example, the configuration of the driving device 60 in which the heat storage wall 45*d* of the reflector 45 approaches or separates from the inner peripheral surface of the fixing belt 50 is different from the configuration illustrated in FIG. 5. The driving device 60 of the modification example includes a rack 46*b* provided on the side surface of the end portion of the connecting rod 46, a pinion 58 engaged with the rack 46*b*, and a tension spring 59 which biases the end portion of the connecting rod 46 downwardly. The pinion 58 is coupled to the driving shaft 48 which is driven by a motor (not illustrated). In a case of the modification, by the pinion 58 and the rack 46*b*, the rotation of the motor is converted to an elevating or lowering operation of the connecting rod 46 and the reflector 45.

A heat resistant rubber layer is provided around a core metal of the pressure roller 53 and a release layer formed of a fluorine-based resin or the like is provided on the surface of the rubber layer. As illustrated in FIG. 2, the pressure roller 53 is biased by a pressure spring 56 in the direction of the outer peripheral surface of the fixing belt 50. The pressure roller 53 is driven to rotate by the motor 57. When the pressure roller 53 is driven by the motor 57, the sheet P sent to the nip N is sent to the downstream side in the conveyance direction while pressing the outer surface of the fixing belt 50.

As illustrated in FIG. 4, in the center area inside the fixing belt 50 in the longitudinal direction, a first sensor S1 which detects the temperature of the fixing belt 50 is provided. In the center area of the reflector 45 in the longitudinal direction, a second sensor S2 which detects the temperature of the heat storage wall 45*d* is provided. The first sensor S1 detects the temperature of the fixing belt 50 on the upstream side of an area, which is directly heated by radiation by the heater 54, of the circulating fixing belt 50 in the rotation direction. The second sensor S2 detects the temperature of the heat storage wall 45*d* on the upstream side of the arrangement location of the first sensor S1 in the rotational direction of the fixing belt 50. The temperature information detected by the first sensor S1 and the second sensor S2 is input to the control device for controlling the driving device 60.

The control device controls the driving device 60 according to the detected temperature of the fixing belt 50 and the detected temperature of the heat storage wall 45*d*. Specifically, the control device controls the driving device 60 to cause the heat storage wall 45*d* to abut on the inner peripheral surface of the fixing belt 10 when the detected temperature of the heat storage wall 45*d* is higher than the detected temperature of the fixing belt 50 by a predetermined temperature (for example, 10° C.) or higher. The control device controls the driving device 60 to separate the heat storage wall 45*d* from the inner peripheral surface of the fixing belt 10 when the detected temperature of the heat storage wall 45*d* is lower than the detected temperature of the fixing belt 50.

Figure 8:
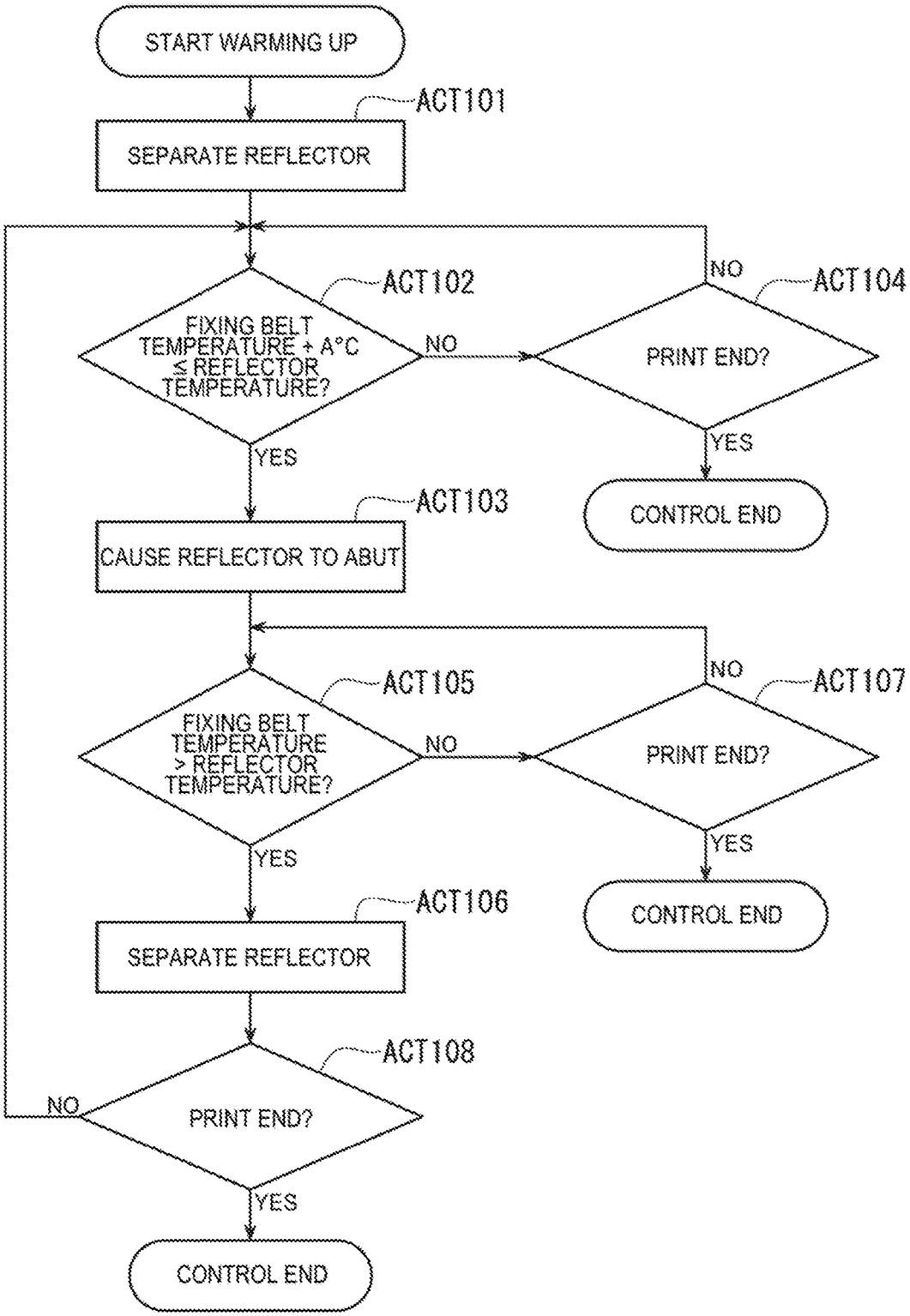
FIG. 8 is a flowchart illustrating an operation of the fixing device.

FIG. 8 is a flow chart illustrating an example of control of the fixing device 34 by the control device. Hereinafter, with reference to FIG. 8, an example of control of the fixing device 34 is described.

When the fixing device 34 is activated by the panel operation of the image forming apparatus 10 or the like, the fixing device stands by for a predetermined period of time so that the temperature of the fixing belt 50 reaches a fixable temperature. At this time, the reflector 45 (heat storage wall 45*d*) inside the fixing belt 50 is separated from the inner peripheral surface of the fixing belt 50 (refer to ACT 101).

If the heat storage wall 45 abuts on the inner peripheral surface of the fixing belt 50 before the fixing belt 50 is sufficiently heated, heat of the fixing belt 50 is absorbed by the reflector 45 (heat storage wall 45*d*) and the temperature increase of the fixing belt 50 is delayed. Therefore, the heat storage wall 45*d* is separated from the inner peripheral surface of the fixing belt 50.

When a predetermined period of time elapses after the fixing device 34 is activated, fixing is started on the sheet P with a toner. When fixing is started, the fixing belt 50 is continuously heated by the heater 54. However, when the fixing belt comes into contact with the sheet P in the nip N, the heat is taken away by the sheet P. When the heater 54 is continuously operated, the reflector 45, which reflects the radiant heat of the heater 54, itself, receives the radiant heat of the heater 54 and then gradually heated.

The control device determines whether or not the detected temperature of the reflector 45 (heat storage wall 45*d*) is higher than the detected temperature of the fixing belt 50 by a predetermined temperature A or higher (refer to ACT 102).

The control device operates the driving device 60 to cause the heat storage wall 45*d* to abut on the inner peripheral surface of the fixing belt 50 in a case where the detected temperature of the reflector 45 (heat storage wall 45*d*) is higher than the detected temperature of the fixing belt 50 by a predetermined temperature A or higher (refer to ACT 103). Thus, the heat of the heat storage wall 45*d* of the reflector 45 is transferred to the fixing belt 50 and the fixing belt 50 is efficiently heated by the heat of the heat storage wall 45*d*.

When the detected temperature of the reflector 45 (heat storage wall 45*d*) is not higher than the detected temperature of the fixing belt 50 by a predetermined temperature A or higher, as long as there is no given instruction to end the operation of the fixing device 34 (print end), comparison of the detected temperature of the reflector 45 (heat storage wall 45*d*) and the detected temperature of the fixing belt 50 is continued (refer to ACT 104).

When the heat storage wall 45*d* abuts on the inner peripheral surface of the fixing belt 50, the control device determines whether or not the detected temperature of the reflector 45 (heat storage wall 45*d*) is lower than the detected temperature of the fixing belt 50 (refer to ACT 105).

In a case where the detected temperature of the reflector 45 (heat storage wall 45*d*) is lower than the detected temperature of the fixing belt 50, the control device operates the driving device 60 to separate the heat storage wall 45*d* from the inner peripheral surface of the fixing belt 50 (refer to ACT 106). In a case where the detected temperature of the reflector 45 (heat storage wall 45*d*) is not lower than the detected temperature of the fixing belt 50, the control device continues comparison of the detected temperature of the reflector 45 (heat storage wall 45*d*) and the detected temperature of the fixing belt 50 as long as there is no given instruction to end the operation of the fixing device 34 (print end) (refer to ACT 107).

After the heat storage wall 45*d* is separated from the inner peripheral surface of the fixing belt 50 by the operation of the driving device 60, as long as there is no given instruction to end the operation of the fixing device 34 (print end), the control device repeatedly performs the above control (refer to ACT 108).

In the fixing device 34 of the embodiment, the heat storage wall 45*d* (heat storage section) is provided integrally with the reflector 45 and the heat storage wall 45*d* is set to be approachable to or separable from the inner peripheral surface of the fixing belt 50 by the driving device 60. Therefore, the heat of the reflector 45 heated by the heater 54 is effectively used so that the fixing belt 50 can be efficiently heated.

The fixing device 34 of the embodiment includes the first sensor S1 which detects the temperature of the fixing belt 50 and the second sensor S2 which detects the temperature of the heat storage wall 45*d* of the reflector 45 and the control device controls the driving device 60 based on the detected temperature. Therefore, according to a relative temperature state of the fixing belt 50 and the heat storage wall 45*d*, the fixing belt 50 can be accurately heated by the heat of the heat storage wall 45*d*. Particularly, in the fixing device 34 of the embodiment, when the detected temperature of the heat storage wall 45*d* is higher than the detected temperature of the fixing belt 50 by a predetermined temperature or higher, the driving device 60 causes the heat storage wall 45*d* to abut on the inner peripheral surface of the fixing belt 50. In addition, when the detected temperature of the heat storage wall 45*d* is lower than the detected temperature of the fixing belt 50, the driving device 60 causes the heat storage wall 45*d* to separate from the inner peripheral surface of the fixing belt 50. Therefore, during the operation of the fixing device 34, when the reflector 45 is sufficiently heated by the radiant heat of the heater 54, the fixing belt 50 can be efficiently heated with the heat of the reflector 45, and inversely, the heat of the fixing belt 50 can be prevented from being taken away by the reflector 45.

In the fixing device 34 of the embodiment, the heat storage wall 45*d* (heat storage section) is formed to have a circular arc cross sectional shape substantially along the inner peripheral surface of the fixing belt 50. Therefore, when the heat is transferred from the heat storage wall 45*d* to the fixing belt 50, the heat storage wall 45*d* can be brought into contact with the inner peripheral surface of the fixing belt 50 over a wide area while suppressing an increase in sliding resistance between the fixing belt 50 and the heat storage wall 45*d*. Accordingly, according to the fixing device 34 of the embodiment, the fixing belt 50 can be efficiently heated by the heat storage wall 45*d* while suppressing deterioration in the fixing belt 50 and the heat storage wall 45*d* or loss in driving energy.

Further, in the fixing device 34 of the embodiment, the combined heat capacity of the main body section of the reflector 45 and the heat storage wall 45*d* is set to be larger the heat capacity of the fixing belt, and is preferably set to be three times or more than the heat capacity of the fixing belt. Therefore, a sufficient amount of heat stored in the main body section of the reflector 45 and the heat storage wall 45*d* can be transferred to the fixing belt 50 and the frequency of approaching or separation of the heat storage wall 45*d* with respect to the fixing belt 50 can be reduced.

In the fixing device 34 of the embodiment, the heat storage wall 45*d* is controlled to separate from the inner peripheral surface of the fixing belt 50 until a predetermined period of time elapses after the start of the activation. Therefore, immediately after the start of the activation of the fixing device 34, the heat of the fixing belt 50 is not taken away by the reflector 45. Accordingly, it is possible to suppress a delay in preparation for heating of the fixing belt 50.

However, in the embodiment, the reflector 45 is formed to have a length over the center area of the corresponding to the sheet passing area A1 of the fixing belt 50 in the longitudinal direction and the end areas on both sides corresponding to the sheet non-passing areas A2 in the longitudinal direction (refer to FIG. 2). Therefore, when the heat storage wall 45*d* of the reflector 45 abuts on the inner peripheral surface of the fixing belt 50, it is considered that the end areas of the fixing belt 50 in the longitudinal direction may be excessively heated. In this case, the heat storage wall 45*d* may be formed only at the center area corresponding to the sheet passing area A1 in the longitudinal direction and the heat storage wall 45*d* may not abut on the end areas of the fixing belt 50.

As another countermeasure, it is possible to change the heat capacity per unit area in a first area which is the center area of the reflector 45 in the longitudinal direction (corresponding to the sheet passing area A1 in FIG. 2) and second areas which are the end areas of the reflector 45 in the longitudinal direction (corresponding to the sheet non-passing areas A2 in FIG. 2). Specifically, for example, the heat capacity per unit area in the second area is set to be smaller than the heat capacity per unit area in the first area by making the thickness of the second area thinner than the thickness of the first area at the center of the reflector 45 or the like.

Figure 9:
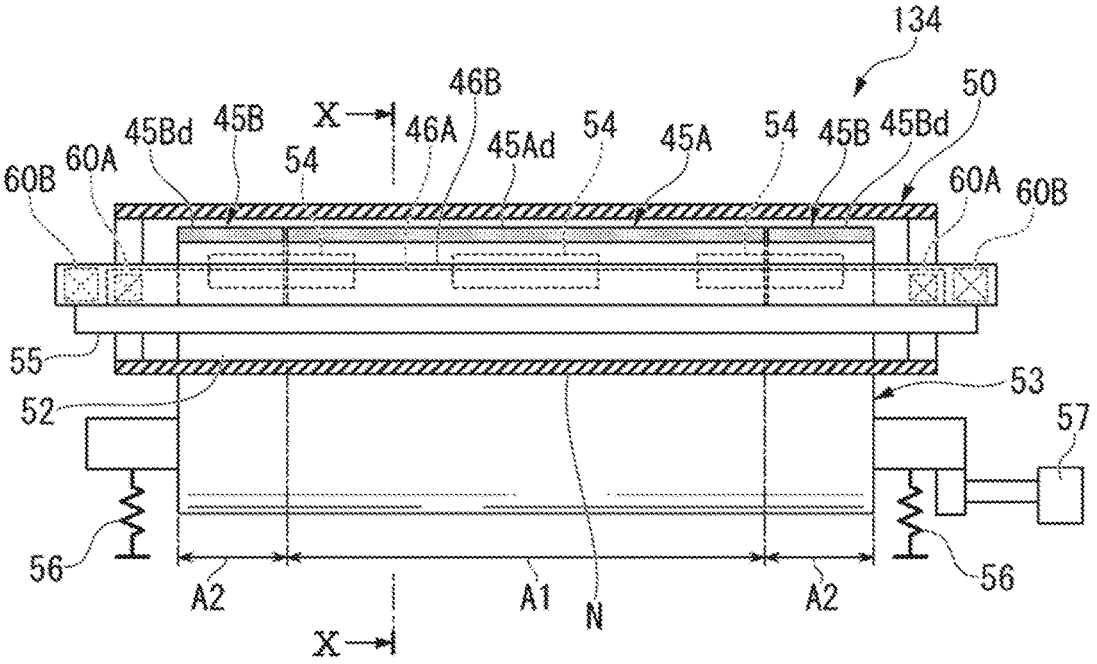
FIG. 9 is a top view of a cross section of a part of a fixing device according to another embodiment.
Figure 10:
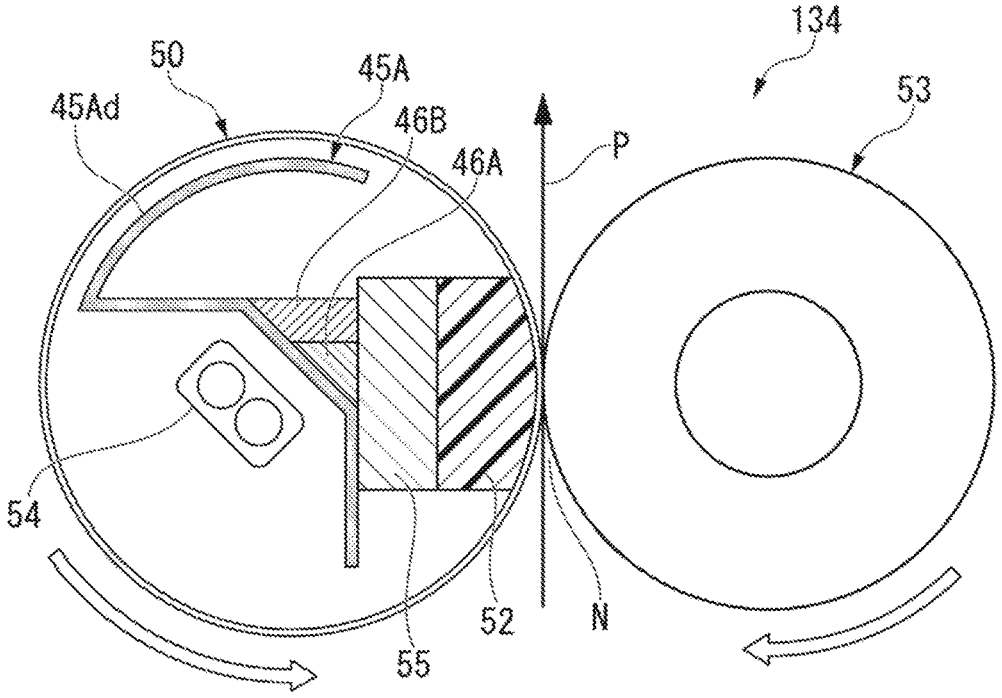
FIG. 10 is a cross-sectional view of the fixing device taken along line X-X in FIG. 9.

FIG. 9 is a partially cross-sectional top view of a fixing device 134 of another embodiment. FIG. 10 is a cross-sectional view of the fixing device 134 of another embodiment taken along line X-X in FIG. 9.

The fixing device 134 is configured such that the reflector arranged inside the fixing belt 50 includes a first reflector 45A arranged in the first area (A1) at the center of the fixing belt 50 in the longitudinal direction and second reflectors 45B arranged in the second areas (A2) at both ends of the fixing belt 50 in the longitudinal direction. A first heat storage wall 45Ad (first heat storage section) capable of abutting on the first area (A1) of the fixing belt 50 is integrally formed with the first reflector 45A. Second heat storage walls 45Bd (second heat storage sections) capable of abutting on the second areas (A2) of the fixing belt 50 are integrally formed with the second reflector 45B.

The first reflector 45A is coupled to a first connecting rod 46A, and second reflectors 45B on both sides are coupled to a common second connecting rod 46B. Both the first connecting rod 46A and the second connecting rod 46B protrude to the outside from the both end portions of the fixing belt 50 in the longitudinal direction. The second connecting rod 46B is arranged above the first connecting rod 46A and further extends to the outside from the first connecting rod 46A in the longitudinal direction.

On the lower sides of the both end portions of the first connecting rod 46A, first driving devices 60A for elevating or lowering the first connecting rod 46A are arranged. On the lower sides of the both end portions of the second connecting rod 46B, second driving devices 60B for elevating or lowering the second connecting rod 46B are arranged. In the embodiment, the first reflector 45A at the center is elevated or lowered by a first driving device 60A through the first connecting rod 46A. In addition, the second reflectors 45B at the both ends are elevated or lowered by a second driving device 60B through the second connecting rod 46B. Accordingly, the first heat storage wall 45Ad of the first reflector 45A and the second heat storage walls 45Bd of the second reflectors 45B independently approach or separate from the inner peripheral surface of the fixing belt 50.

The first driving device 60A and the second driving devices 60B are controlled by a control device in the following manner until a predetermined period of time elapses from the start of the activation of the fixing device 134.

That is, the first driving device 60A causes the first heat storage wall 45Ad (first reflector 45A) to separate from the inner peripheral surface of the fixing belt 50 until a predetermined period of time elapses from the start of the activation of the fixing device 134. Thus, the heat of the first area (A1) of the fixing belt 50 is not taken away by the first heat storage wall 45Ad. As a result, the temperature increase of the first area (A1) of the fixing belt 50 is promoted.

The second driving device 60B causes the second heat storage wall 45Bd (second reflector 45B) to abut on the inner peripheral surface of the fixing belt 50 until a predetermined period of time elapses from the start of the activation of the fixing device 134. Thus, the heat of the second areas (A2) of the fixing belt 50 is taken away by the second heat storage walls 45Bd. As a result, the end area of the fixing belt 50 in the longitudinal direction is prevented from being excessively heated.

The basic configuration of the fixing device 134 of another embodiment is the same as the configuration of the fixing device of the above embodiment. Therefore, it is possible to obtain the same basic effect as in the above embodiment.

In the above embodiment, the sensor which detects the temperature of the fixing belt 50 is provided only at the center area of the fixing belt 50 in the longitudinal direction. However, temperature sensors S1 and S3 may be respectively provided in the center area and the end areas of the fixing belt 50 (refer to FIG. 4). In this case, differences between the temperature detected by each of the temperature sensors S1 and S3 and the temperature of the heat storage wall 45*d* detected by the temperature sensor S2 are respectively investigated, and the driving device 60 is controlled by using two temperature differences. For example, when the detected temperature of the temperature sensor S1 at the center is lower than the detected temperature of the temperature sensor S2 and the detected temperature of the temperature sensor S3 at the end portion is lower than the detected temperature of the temperature sensor S2, the heat storage wall 45*d* may be brought into contact with the fixing belt 50. In addition, a threshold value when a temperature difference between the detected temperature of the temperature sensor S1 at the center and the detected temperature of the temperature sensor S2 is determined and a threshold value when a temperature difference between the detected temperature of the temperature sensor S3 at the end portion and the detected temperature of the temperature sensor S2 is determined are set to be different from each other and in a case where two temperature differences exceed the respective corresponding threshold values, the heat storage wall 45*d* may be brought into contact with the fixing belt 50. Further, even when the heat storage wall 45*d* is separated from the fixing belt, control may be performed based on two temperature differences as in a case where the heat storage wall is brought into contact with the fixing belt.

According to at least one of the embodiments described above, it is possible to efficiently heat the fixing belt by effectively using heat of the reflector heater in the fixing device including the reflector.

What is claimed is:

1. A fixing device for fixing a toner image onto a medium, the fixing device comprising:

a circulating member for fixing toner and having an annular peripheral wall movable circularly;

a pressure member facing an outer peripheral surface of the circulating member and forming a nip with the circulating member;

a heater inside the circulating member and operable to heat the circulating member;

a reflector inside the circulating member and operable to reflect radiant heat of the heater to the circulating member;

a heat storage section provided integrally with the reflector or connected to the reflector; and a driver operable to move the heat storage section to abut on or separate from an inner peripheral surface of the circulating member, wherein the driver includes a first temperature sensor provided in the circulating member and a second temperature sensor provided in the heat storage section, and the driver is configured to cause the heat storage section to abut on or separate from the inner peripheral surface of the circulating member according to a temperature difference between a detected temperature at the first temperature sensor and a detected temperature at the second temperature sensor.

2. The device according to claim 1, wherein the driver is configured to cause the heat storage section to abut on the inner peripheral surface of the circulating member when a temperature of the heat storage section is higher than a temperature of the circulating member by a predetermined temperature, and cause the heat storage section to separate from the inner peripheral surface of the circulating member when the temperature of the heat storage section is lower than the temperature of the circulating member.

3. The device according to claim 1, wherein the heat storage section has a circular arc cross-sectional shape substantially along the inner peripheral surface of the circulating member.

4. The device according to claim 1, wherein a combined heat capacity of the heat storage section and a main body of the reflector is set to be larger than a heat capacity of the circulating member, which comprises a fixing belt.

5. The device according to claim 1, wherein the driving device driver is configured to cause the heat storage section to separate from the inner peripheral surface of the circulating member for a predetermined period of time.

6. The device according to claim 1, wherein the heat storage section is set to abut on or be separable from a center area of the circulating member in a longitudinal direction.

7. The device according to claim 1, wherein the circulating member includes a first area that is a center area in a longitudinal direction and second areas that are outside the first area in the longitudinal direction, the heat storage section includes a first heat storage section capable of abutting on the first area and a second heat storage section capable of abutting on the second area, and the second heat storage section has a heat capacity per unit area smaller than a heat capacity per unit area in the first heat storage section.

8. The device according to claim 1, wherein the circulating member includes a first area that is a center area in a longitudinal direction and second areas that are outside the first area in the longitudinal direction, the heat storage section includes a first heat storage section capable of abutting on the first area and a second heat storage section capable of abutting on the second area, the first heat storage section and the second heat storage section are set to be independently approachable to or separable from the inner peripheral surface of the circulating member, and the driver is configured to cause the first heat storage section to separate from the inner peripheral surface of the circulating member and to the second heat storage section to abut on the inner peripheral surface of the circulating member until a predetermined period of time elapses from start of activation of the fixing device.

9. An image forming apparatus comprising:

a printer configured to transfer a toner image onto a recording medium; and a fixing device configured to apply energy to fix toner onto the recording medium onto which the toner image is transferred, wherein the fixing device includes a circulating member for fixing toner and having an annular peripheral wall that is circularly movable, a pressure member facing an outer peripheral surface of the circulating member and forming a nip with the circulating member, a heater inside the circulating member and operable to heat the circulating member, a reflector inside the circulating member and operable to reflect radiant heat of the heater to the circulating member, a heat storage section provided integrally with the reflector or connected to the reflector, and a driver configured to cause the heat storage section to abut on or separate from an inner peripheral surface of the circulating member, wherein the driver includes a first temperature sensor provided in the circulating member and a second temperature sensor provided in the heat storage section, and the driver is configured to cause the heat storage section to abut on or separate from the inner peripheral surface of the circulating member according to a temperature difference between a detected temperature at the first temperature sensor and a detected temperature at the second temperature sensor.

10. The image forming apparatus of claim 9, wherein the driver is configured to cause the heat storage section to abut on the inner peripheral surface of the circulating member when a temperature of the heat storage section is higher than a temperature of the circulating member by a predetermined temperature, and to cause the heat storage section to separate from the inner peripheral surface of the circulating member when the temperature of the heat storage section is lower than the temperature of the circulating member.

11. The image forming apparatus of claim 9, wherein the heat storage section has a circular arc cross-sectional shape substantially along the inner peripheral surface of the circulating member.

12. The image forming apparatus of claim 9, wherein a combined heat capacity of the heat storage section and a main body of the reflector is set to be larger than a heat capacity of the circulating member, which comprises a fixing belt.

13. A heat transfer belt assembly for transferring heat to a medium by conduction, the heat transfer belt comprising:

a circular wall rotatable around a holding member, the circular wall having an inner surface and an outer surface;

a heater operable to emit heat radiation onto the inner surface of the circular wall;

a reflector partially embracing the heater to direct the emitted heat radiation onto the inner surface of the circular wall, the reflector held by the holding member and operable to move relative to the circular wall;

a heat storage section provided integrally with the reflector or connected to the reflector such that the heat storage section is movable to abut the inner surface of the circular wall to transfer heat absorbed by the reflector from the heater; and a first sensor operable to measure a temperature of the heat storage section and a second sensor operable to measure a temperature of the inner surface of the circular wall, wherein the heat storage section is configured to be moved to abut on the inner surface of the circular wall when the temperature of the heat storage section is higher than the temperature of the inner surface by a predetermined amount, and wherein the heat storage section is configured to be moved away from the inner surface of the circular wall when the temperature of the heat storage section is lower than the temperature of the inner surface.

14. The heat transfer belt assembly of claim 13, further comprising a pad material affixed onto the holding member and supporting the inner surface for contact with a pressure roller, wherein the pressure roller forms a nip with a portion of the outer surface of the circular wall supported by the pad material for receiving the medium for fixing.

15. The heat transfer belt assembly of claim 13, wherein the heat storage section has an arc shape of a radius similar to that of the circular wall, and the heat storage section is tangentially slidable against the inner surface of the circular wall when the heat storage section is moved to abut the inner surface of the circular wall.

16. The heat transfer belt assembly of claim 13, wherein the reflector is actuated by a driver having a cam.

17. The heat transfer belt assembly of claim 13, wherein the reflector is actuated by a driver having a plurality of teeth.

* * * * *